US006813798B2

(12) United States Patent
Moga

(10) Patent No.: US 6,813,798 B2
(45) Date of Patent: Nov. 9, 2004

(54) FINGER CLEANING APPARATUS

(76) Inventor: Michael P Moga, P.O. Box 31571, Tucson, AZ (US) 85751

( * ) Notice: Subject to any disclaimer, the term of this patent is extended or adjusted under 35 U.S.C. 154(b) by 77 days.

(21) Appl. No.: 10/012,073

(22) Filed: Oct. 29, 2001

(65) Prior Publication Data

US 2003/0081980 A1 May 1, 2003

(51) Int. Cl.[7] ..... A46B 11/00

(52) U.S. Cl. ..... 15/104.93; 15/160; 15/167.3; 15/210.1; 401/9; 401/11

(58) Field of Search ..... 15/167.3, 104.04, 15/160, 164, 104.93, 104.92, 106, 210.1; 132/73, 75.6, 73.5; 401/9, 10, 11

(56) References Cited

U.S. PATENT DOCUMENTS

| | | | | | |
|---|---|---|---|---|---|
| 490,682 | A | * | 1/1893 | Roemer | 15/191.1 |
| 981,233 | A | * | 1/1911 | Wippler | 15/164 |
| 1,710,127 | A | * | 4/1929 | Vaughn | 15/106 |
| 1,728,712 | A | * | 9/1929 | Aberle | 15/160 |
| 2,128,011 | A | * | 8/1938 | Morgan | 15/164 |
| 2,404,507 | A | * | 7/1946 | Link | 15/104.011 |
| 3,135,987 | A | * | 6/1964 | Huch | 15/104.92 |
| 3,378,873 | A | * | 4/1968 | Strout | 15/244.1 |
| 4,014,063 | A | * | 3/1977 | Bunke | 15/111 |
| 4,130,908 | A | * | 12/1978 | Alcamo | 15/21.1 |
| 4,301,567 | A | * | 11/1981 | Tucker | 15/160 |
| 4,862,549 | A | * | 9/1989 | Criswell et al. | 15/104.04 |
| 5,222,271 | A | * | 6/1993 | Eganhouse | 15/104.92 |
| 5,471,706 | A | * | 12/1995 | Wallock et al. | 15/302 |
| 5,493,748 | A | * | 2/1996 | Santo | 15/104.04 |
| 6,086,275 | A | * | 7/2000 | King | 401/11 |
| 6,314,965 | B1 | * | 11/2001 | Walker | 132/74.5 |

FOREIGN PATENT DOCUMENTS

| | | | | |
|---|---|---|---|---|
| DE | 452854 | * | 11/1927 | 15/160 |

* cited by examiner

*Primary Examiner*—Gary K. Graham
(74) *Attorney, Agent, or Firm*—Mark Ogram

(57) ABSTRACT

A tool for cleaning fingers which includes, in the preferred embodiment, two interlocking tubes. Each tube is configured to accept a finger from the user. Within the first tube is a longitudinal brush used to clean the sides of the inserted finger as the tube is rotated around the finger. At an end of the tube is another brush which cleans the finger nail area while the tube is rotated. The second tube includes a soft brush is used to softly clean or buff the finger. Holes in the tube permit soap to enter and be used for the cleaning process. In one embodiment, soap is dispensed from a cavity in the tubes. In other embodiments of the invention, the bristles on the brushes are coated with an anti-bacterial agent.

16 Claims, 2 Drawing Sheets

FINGER CLEANING APPARATUS

BACKGROUND OF THE INVENTION

This invention relates generally to hygienic tools and more particularly to tools used to clean the hands and fingers.

Not only does civilized society demand cleanliness, but, basic hygiene also requires regular and thorough cleaning of the body. While the majority of the skin is either easily cleaned or is not excessively exposed to dirt and disease, the same cannot be said of the hands.

By their very nature, the hands are exposed in daily life and work to a wide range of grime and disease. The fingers pose the most difficult scenario for cleaning. The fingers provide extensive surface space which is not readily accessed with a hand brush; and the fingernails are particularly difficult to clean. Even after a thorough washing, a mechanic often still has "black" fingernails.

Whether the cleaning required is after work in the garden or on the car, or requires antiseptic levels for medical procedures, cleaning of the fingers and fingernails is particularly difficult and time consuming. Since the task is so very time consuming, often the cleaning is haphazardly done.

It is clear from the foregoing that there is a need for an efficient tool to assist in the cleaning of fingers and fingernails.

SUMMARY OF THE INVENTION

The invention is a tool for cleaning fingers. In one embodiment of the invention, a closed-ended tube is used. The tube is large enough to accept a to-be-cleaned finger into the tube. Ideally, the tube's length is not longer than the shortest of the user's fingers; this attribute will become clear later.

The preferred embodiment has two interlocking tubes. Both tubes are closed ended with the open ends mating/connecting with each other. This interlocking attribute provides for an easily "sealed" or contained apparatus for transport or storage between uses.

Each tube is configured to accept a finger from the user. Ideally, the first tube is used by the user initially with the second tube performing an optional cleaning or buffing function.

Within the first tube is a longitudinal brush. The longitudinal brush is used to clean the sides of the inserted finger as the tube is rotated around the finger. The longitudinal brush is secured to the tube through a variety of ways, obvious to those of ordinary skill in the art.

Two such methods include: securing the longitudinal brush to the interior wall of the tube; and, securing an end of the longitudinal brush to the closed end of the tube.

In the latter situation, where the longitudinal brush is secured to the end of the tube, in some embodiments the end of the tube is removable. The ability to remove the end of the tube (and hence the longitudinal brush) permits the brush and tube to be easily cleaned, or the replacement of the longitudinal brush.

In the preferred embodiment, an end brush is secured to the interior portion of the closed end of the tube. This end brush permits the user to press the fingernail against the end brush. When the tube is rotated, the end brush moves against the surface and end of the fingernail to clean the fingernail. This action provides excellent cleaning beneath the fingernail.

In the embodiment where two tubes are used, the second tube includes a soft brush is used to softly clean the finger. This tube "buffs" the finger and fingernail to provide a finishing cleaning operation.

Holes in the tube permit soap to enter and be used for the cleaning process. When the tube is in use, the user places the tube and finger under the stream of water and soaps the assembly, allowing the soap and water to enter the tube to assist in the cleaning process as the tube is rotated.

In one embodiment, a cavity is created within the tube. This cavity is "charged" or loaded with soap, lotion, or antibacterial agents, using an exterior opening or portal. The liquid within the cavity is dispensed from the cavity into the interior of the tube; then, as the tube is rotated, the soap, lotion, or antibacterial lotion heightens the cleaning process.

To provide an antiseptic environment, some embodiments of the invention provide for a coating of anti-bacterial agents on the bristles on the brushes. This embodiment provides an anti-bacterial agent without any effort on the part of the user; periodically, the entire unit is replaced or the brushes are replaced (as in the case of the longitudinal brushes connected to a removable end-cap).

The invention, together with various embodiments thereof, will be more fully explained by the accompanying drawings and following description thereof.

DRAWINGS IN BRIEF

FIGS. 1A, 1B, and 1C are perspective, side and end views respectively of the preferred embodiment of the single tube version of the invention.

DRAWINGS IN DETAIL

Figure 1A:
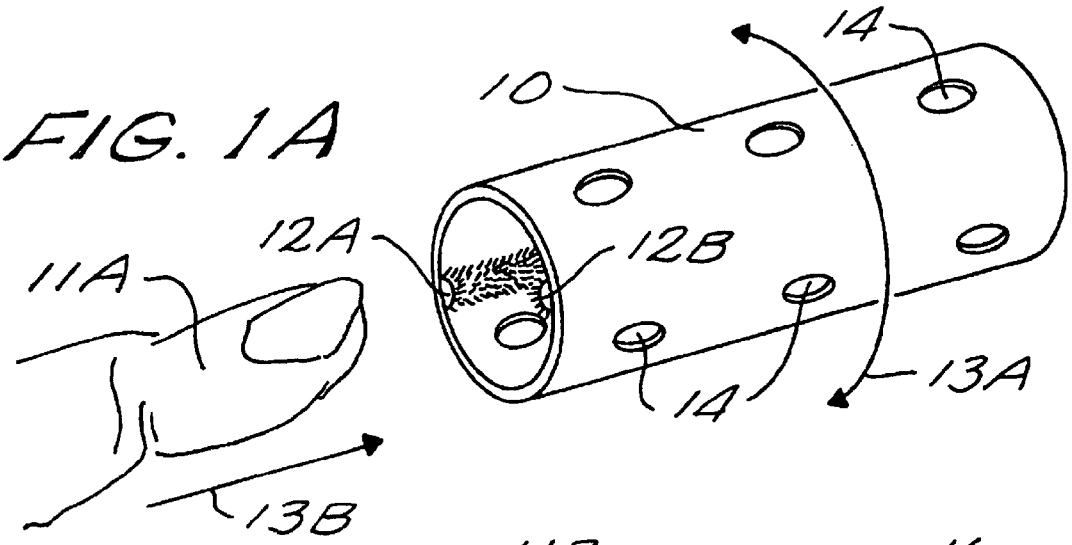
Figure 1B:
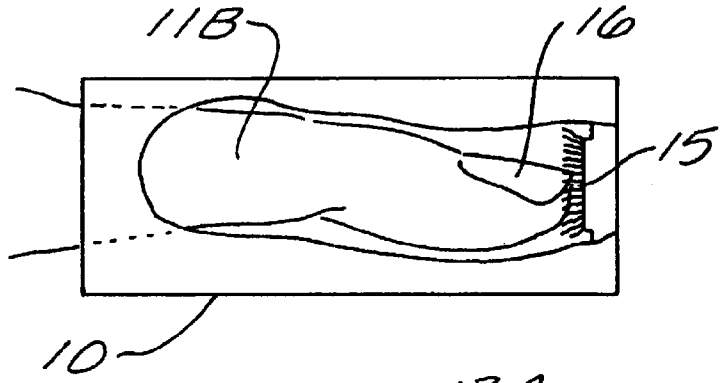
Figure 1C:
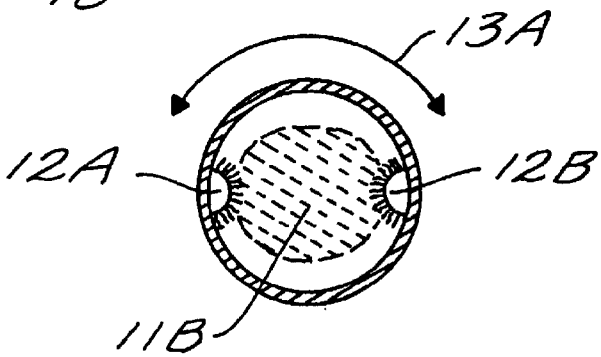

FIGS. 1A, 1B, and 1C are perspective, side, and end views respectively of the preferred embodiment of the invention.

Finger 11A is inserted into the hollow tube 10 as indicated by arrow 13B. Finger 11B, once positioned within tube 10, extends to the closed end of tube 10, thereby allowing fingernail 16 to engage end-brush 15.

The two longitudinal brushes 12A and 12B are secured to an inner wall of hollow tube 10 and contact the edges of finger 11B. While this illustration shows the use of two longitudinal brushes, the invention is not so limited and includes any number of longitudinal brushes.

The user grips tube 10 with his/her free hand (not shown) and rotates tube 10 as shown by arrow 13A. This motion causes longitudinal brushes 12A and 12B to scrub the sides of finger 11B while end brush 15 cleans the fingernail area.

Holes 14 in hollow tube 10 allow easy access and drainage of water and soap into the interior scrubbing area. Through the use of antibacterial soap, the finger is also "sanitized" to reduce infection.

The unit is intended to be either disposable after a certain number of uses, or may be placed into a cleaning apparatus to remove sloughed skin and debris that may build up within tube 10.

Figure 2:
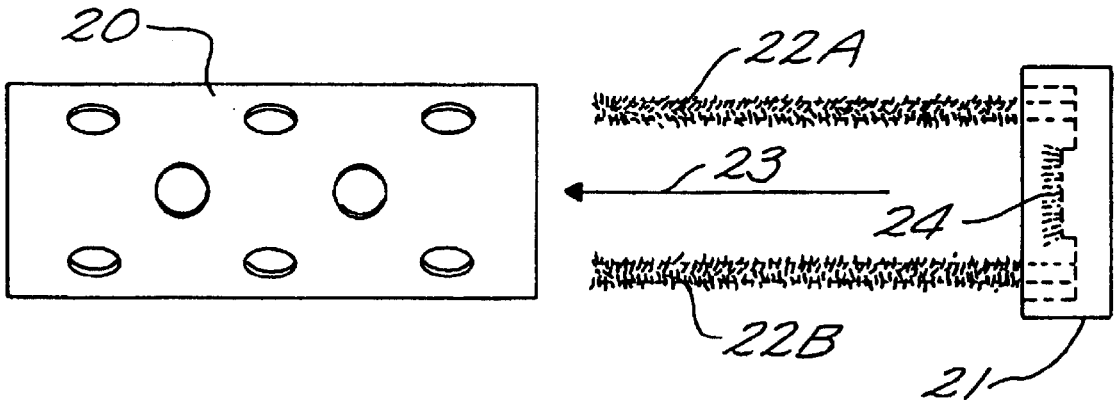
FIG. 2 is a side view of an alternative embodiment of the invention.

FIG. 2 is a side view of an alternative embodiment of the invention.

In this embodiment, tube 20 is completely hollow with both ends open. End cap 21 has secured to it the longitudinal brushes 22A and 22B as well as end brush 24. End cap 21 is inserted over an end of tube 20 and is secured thereto (ideally through a frictional bond).

Once end cap 21 is secured to tube 20, the user is able to insert their finger into the open end of tube 20 and operate the assembly as outlined above.

This embodiment of the invention allows the removal of the brushes for either replacement of the brushes or easy cleaning thereof.

Figure 3A:
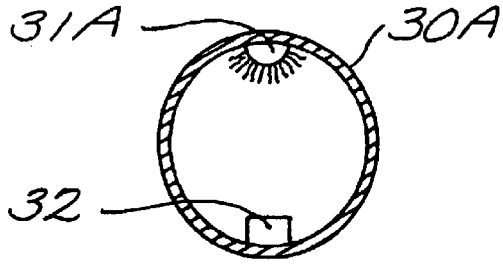
FIGS. 3A and 3B are end views of some embodiments of the invention.
Figure 3B:
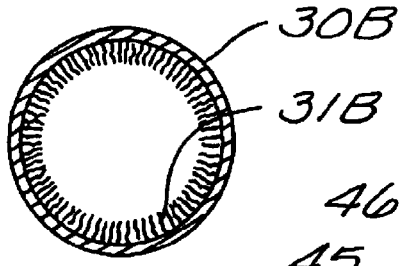

FIGS. 3A and 3B are end views of alternative embodiments of the invention.

Referring to FIG. 3A, tube 30A has a single longitudinal brush 31A affixed to an inner wall. Also secured to an interior wall of tube 30A is soap 32. During the rotating action described above, soap 32 dissolves and assists in the cleaning action performed by longitudinal brush 31A.

This embodiment of the invention is particularly useful for single use disposable brushes such as those used by physicians in preparation of surgery or some other medical procedure. In these cases, soap 32 contains a highly effective antibacterial to assure the thorough cleaning of the fingers and fingernails before the medical procedure.

FIG. 3B illustrates another embodiment of the invention in which the entire inner surface of tube 30B is covered by brush 31B. This embodiment of the invention provides for a heightened level of cleaning action as any particularly area of the finger is in constant contact with a brushing element.

Figure 4:
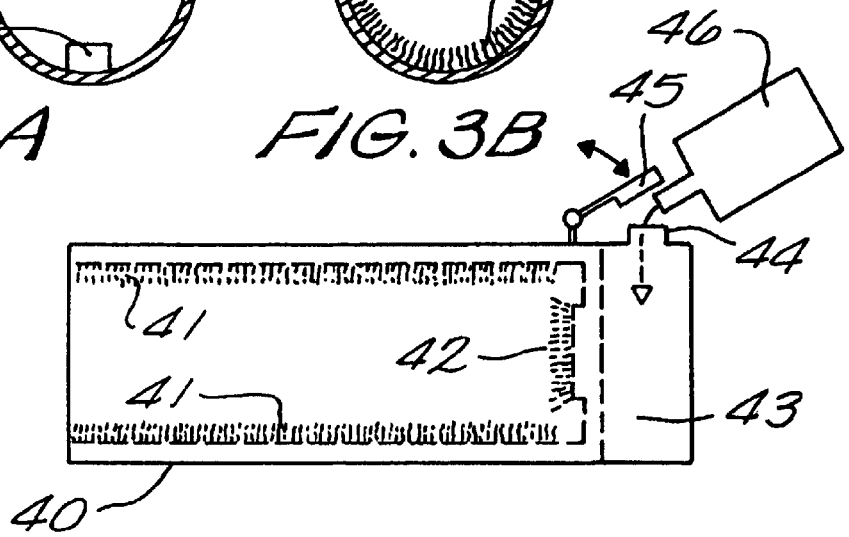
FIG. 4 is a side view of an alternative embodiment of the invention which utilizes a soap/anti-bacterial dispensing cavity.

FIG. 4 is a side view of an alternative embodiment of the invention which utilizes a soap/anti-bacterial dispensing cavity.

Tube 40 is equipped with longitudinal brushes 41 as well as end brush 42. In this embodiment, cavity 43 communicates with the rest of the interior of tube 40 via a permeable wall or via small holes in the wall.

Liquid 46 is deposited into cavity 43 via fill port 44. Once the proper amount of liquid (soap or antibacterial agents), fill port 44 is capped via cap 45 to assure the liquid services the interior of tube 40.

This particular embodiment allows the user to select the liquid, which can include a softening lotion that is to be worked into the skin and fingernail.

Figure 5A:
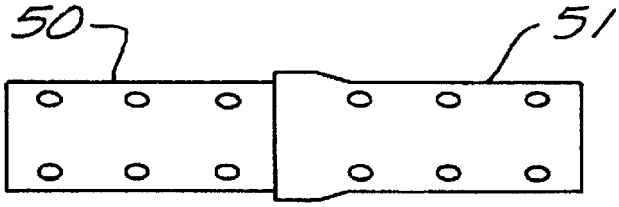
FIGS. 5A and 5B are side views of the preferred embodiment of the invention having two tubes.
Figure 5B:
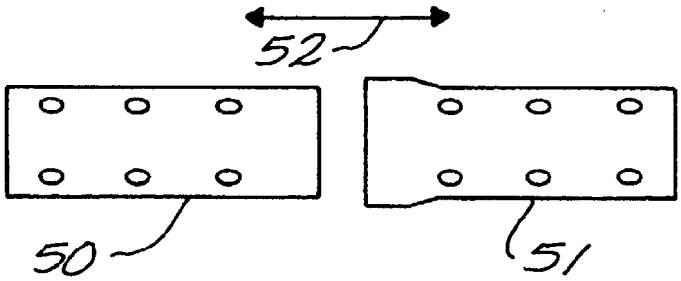

FIGS. 5A and 5B are side views of an alternative embodiment of the invention having two tubes.

As shown in FIG. 5A, tube 50 and 51 are nested to each other. In this embodiment, tubes 50 and 51 are any of those outlined above. Ideally, the bristles of the brushes within tube 50 are "softer" or less abrasive than the bristles of the brushes within tube 51. This allows the user to either select the strength of the scrubbing action; or, to use the softer brushes to "buff" the finger and nail once the finger has been cleaned.

FIG. 5B shows the disconnecting of tube 50 from 51 as indicated by arrow 52. For storage and transport, the two tubes are connected to each other.

Figure 6:
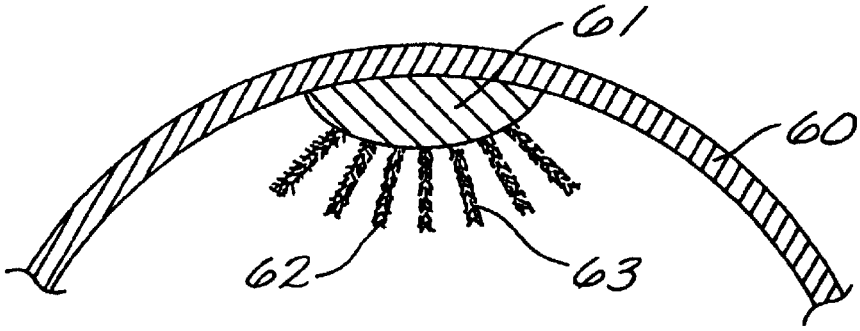
FIG. 6 is a close-up view of a brush illustrating the use of a coating of antibacterial agents on the bristles of the brush.

FIG. 6 is a close-up view of a brush illustrating the use of a coating of antibacterial agents on the bristles of the brush.

In some embodiments of the invention, bristles 62 on longitudinal brush 61 are coated with an antibacterial agent 63. When longitudinal brush 61 is mounted onto the interior wall of tube 60, the assembly permits the fingers to be both cleaned and sanitized without the addition of any liquids (other than the water).

It is clear that the present invention provides for a highly efficient and easy to use apparatus for the cleaning of fingers and fingernails.

What is claimed is:

1. A tool for cleaning fingers comprising a hollow handheld tube having:

a) a closed end and an open end through which a finger can be inserted;

b) at least one longitudinal brush contained within said hollow handheld tube and secured a longitudinal interior wall of said hollow handheld tube;

c) an end brush secured to an interior surface of the closed end of said hollow handheld tube; and, d) a solid soap portion secured to an interior surface of said hollow handheld tube.

2. The tool for cleaning fingers according to claim 1, wherein at least one longitudinal brush is secured to the closed end of said hollow handheld tube.

3. The tool for cleaning fingers according to claim 2, wherein said closed end of said hollow handheld tube is removable from said hollow handheld tube.

4. The tool for cleaning fingers according to claim 1, wherein said hollow handheld tube includes a plurality of holes in a wall thereof.

5. The tool for cleaning fingers according to claim 4, further including a coating of antibacterial agents disposed on bristles of said longitudinal brush and said end brush.

6. The tool for cleaning fingers according to claim 1, further including a second hollow handheld tube having a closed end and an open end, said open end of said second hollow handheld tube adapted to be secured to the open end of the hollow handheld tube.

7. The tool for cleaning fingers according to claim 6, wherein the second hollow handheld tube includes a soft brush therein.

8. A tool for cleaning fingers comprising:

a) a first hollow handheld tube having a closed end and an open end through which a finger can be inserted, said first hollow handheld tube having at least one longitudinal brush contained within said hollow handheld tube; and, b) a second hollow handheld tube having a closed end and an open end, the open end of said second hollow handheld tube securable to the open end of said first hollow handheld tube, said second hollow handheld tube having at least one buffing surface longitudinally secured to an interior longitudinal wall thereof.

9. The tool for cleaning fingers according to claim 8, wherein said at least one longitudinal brush is secured to the closed end of said first hollow handheld tube.

10. The tool for cleaning fingers according to claim 9, wherein said closed end of said first hollow handheld tube is removable from said first hollow handheld tube.

11. The tool for cleaning fingers according to claim 8, further including an end brush secured to an interior surface of the closed end of said first hollow handheld tube.

12. The tool for cleaning fingers according to claim 11, wherein said at least one longitudinal brush is secured to a longitudinal interior wall of said first hollow handheld tube.

13. The tool for cleaning fingers according to claim 12, wherein said first hollow handheld tube includes a plurality of holes therethrough.

14. The tool for cleaning fingers according to claim 13, further including a coating of antibacterial agents disposed on bristles of said longitudinal brush and said end brush.

15. The tool for cleaning fingers according to claim 13, further including a dispensing cavity contained within said first hollow handheld tube, said dispensing cavity having an exterior fill port, an interior portion of said dispensing cavity communicating with an interior of said first hollow handheld tube.

16. The tool for cleaning fingers according to claim 15, further including a liquid soap dispenser configured to fill said dispensing cavity via said exterior fill port.

* * * * *